US005449447A

United States Patent [19]

Branders

[11] Patent Number: 5,449,447

[45] Date of Patent: Sep. 12, 1995

[54] METHOD AND DEVICE FOR PICKLING AND GALVANIZING

[75] Inventor: René Branders, Brussels, Belgium

[73] Assignee: Le Four Industriel Belge S.A., Brussels, Belgium

[21] Appl. No.: 39,084

[22] PCT Filed: Oct. 4, 1991

[86] PCT No.: PCT/BE91/00071

§ 371 Date: Jun. 8, 1993

§ 102(e) Date: Jun. 8, 1993

[87] PCT Pub. No.: WO92/06231

PCT Pub. Date: Apr. 16, 1992

[30] Foreign Application Priority Data

Oct. 8, 1990 [BE] Belgium ..... 09000950

[51] Int. Cl.[6] ..... C25D 5/34; C25D 5/50; C25D 17/00; C25F 1/06

[52] U.S. Cl. ..... 205/141; 204/144.5; 204/206; 204/237; 204/269; 204/222; 204/294

[58] Field of Search ..... 204/129.4, 144.5, 129.43, 204/206, 237, 294, 269, 222; 205/138, 141; 118/403, 405, 410

[56] References Cited

U.S. PATENT DOCUMENTS

| | | | |
|---|---|---|---|
| 2,372,599 | 3/1945 | Nachtman | 204/144.5 |
| 2,719,820 | 10/1955 | Allen | 205/141 X |
| 2,860,092 | 11/1958 | Hart et al. | 204/144.5 |
| 3,338,809 | 8/1967 | Stricker | 204/144.5 |
| 3,722,463 | 3/1973 | Kudo et al. | 118/405 X |
| 3,914,481 | 10/1975 | Bostroem | 118/403 X |
| 4,129,485 | 12/1978 | Shikata et al. | 204/144.5 |
| 4,317,848 | 3/1982 | Mellorowicz | 427/309 |
| 4,713,153 | 12/1987 | Adriaensen et al. | 204/144.5 |
| 5,069,158 | 12/1991 | Rey | 118/410 |

FOREIGN PATENT DOCUMENTS

| | | |
|---|---|---|
| 44994 | 3/1971 | Australia . |
| 202870 | 11/1986 | European Pat. Off. . |
| 209168 | 1/1987 | European Pat. Off. . |
| 1488623 | 7/1967 | France . |
| WO9206231 | 4/1992 | WIPO . |

OTHER PUBLICATIONS

Lowenheim, F. A., *Electroplating*, Jan. 8, 1979, pp. 67–81.

Draht, vol. 33, No. 6, Jun. 1982, pp. 384–387.

*Primary Examiner*—Donald R. Valentine

*Attorney, Agent, or Firm*—Birch, Stewart, Kolasch & Birch

[57] ABSTRACT

Method and device for pickling, and possibly for degreasing, of elongate metal items, in particular wires, strips and steel section. These items are placed in an electrolyte solution through which an electric current is passed by means of electrodes, said items being moved preferably in a substantially continuous manner lengthwise through at least two successive separate baths of an aqueous hydrochloric acid solution and/or a chlorine mineral salt solution. At least one electrode is placed in each bath and an electric voltage is applied to these electrodes so that the sign of the voltage on the electrode of one of the baths is always different from the sign of the voltage on the electrode of the adjacent bath, the baths being substantially insulated from each other so that the electric current flows between two adjacent baths mainly via that part of the item being moved between said two adjacent baths.

30 Claims, 2 Drawing Sheets

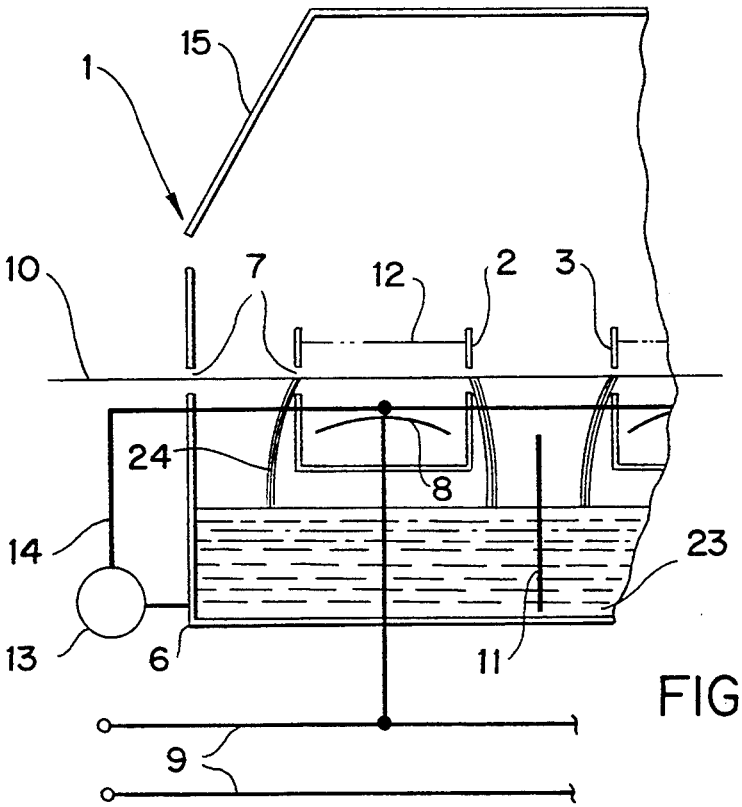
FIG. 3
FIG. 4
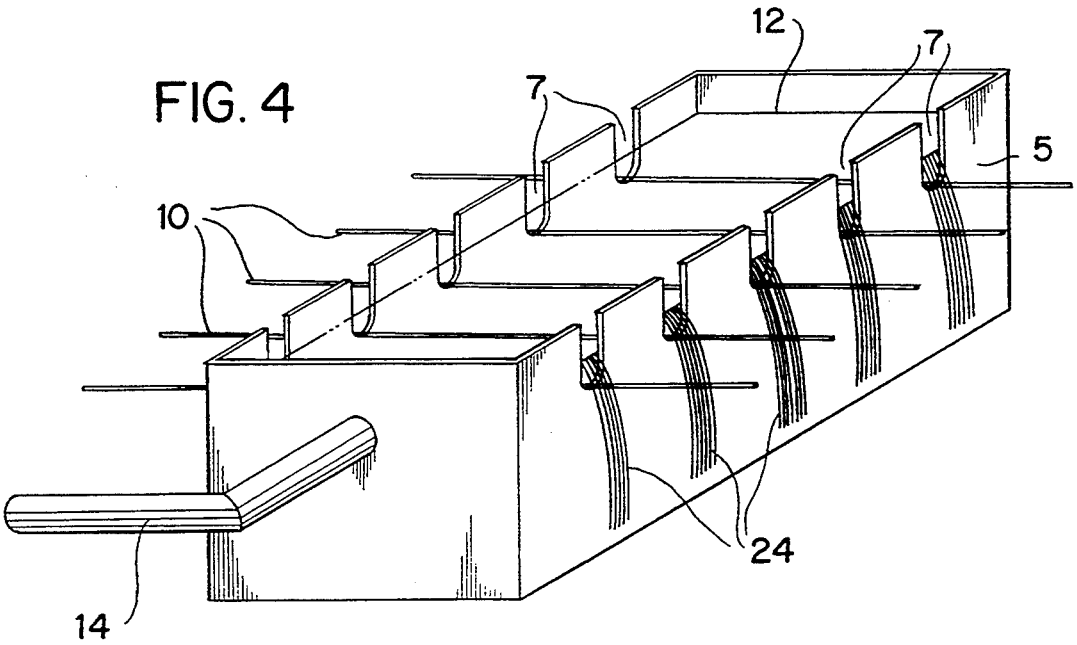

METHOD AND DEVICE FOR PICKLING AND GALVANIZING

The present invention relates to a method for pickling, and possibly for degreasing, elongated metal elements, in particular wires, strips and sectional steel, wherein the metal elements are introduced into an electrolyte solution through which an electric current is passed by means of electrodes.

For simplicity of the description given hereinafter, the elongated metal elements will be referred to as "wires", but it will be clear that which is applicable to "wires" is also applicable to other elements, such as strips and sections.

A method for electrochemical pickling is disclosed in European Patent no. 0 209 168.

However, in this prior patent, pickling in a hydrochloric acid solution by applying an electric current requires an alternating current of a relatively high frequency of at least 200 Hertz, which generally requires the use of a frequency converter. In this respect, it has been stated in the introduction of the description of this patent that neither the use of direct current nor the use of alternating current of the electricity mains (50 or 60 Hertz) is applicable.

One of the essential objects of the present invention is, on the one hand, to obviate the drawbacks of the method of European Patent no. 0 209 169, in particular, the necessity for using frequency converter. Another essential object of the present invention is to propose a method that is suitable for any type of electric current, such as direct current and alternating current at the frequency of the electricity mains.

According to the present invention, the elongated metal elements are preferably moved in a substantially continuous manner in their lengthwise direction through at least two successive separate baths containing an aqueous solution of hydrochloric acid and/or a mineral chlorine salt, wherein in each bath there is placed at least one electrode. An electric voltage is applied to these electrodes in such a manner that the polarity of the electrode of one of the baths is always different from the polarity of the electrode of the adjacent bath, wherein the bath are insulated from each other so that the electric current flows between the two adjacent baths mainly via that portion of the elongated metal element moving between two adjacent baths.

The present invention is also directed to a device for performing the above-described method. This device comprises at least two successive baths that each contain a solution of hydrochloric acid and/or a mineral chlorine salt, said baths being electrically insulated from each other and the elongated metal elements moving therebetween. An electrode is placed in each of these baths at a certain distance, preferably beneath the travelling path of the elongated metal elements, wherein one electrode is connected to one of the poles of a low voltage electric current generator, while the electrode of the adjacent bath is connected to the other pole of this generator.

The present invention further relates to a method for continuously galvanizing elongated metal elements, in particular wires, strips and sectional steel, comprising at least a thermal treatment step, a pickling step possible combined with a degreasing step and a step of coating the surface of these elements with a film of zinc, wherein the elongated metal elements are moved in a substantially continuous manner in their lengthwise direction through these steps. The pickling step comprising moving the elements in an electrolyte solution bath, in particular, of a mineral acid.

In practice, the wires to be galvanized generally have a surface coated with two distinct substances, i.e.

1) oxide of the basic metal, and
2) a wire-drawing lubricant, such as stearates, phosphates, etc.

In order to obtain good adherence of zinc to the surface of the wires, the oxide and lubricant must be eliminated while limiting the loss of basic metal.

In certain known methods, the surface treatment precedes the thermal treatment. These methods have, however, the drawback in that high glavanizing speeds cannot be obtained, the difficulty is the duration of the oxide reduction during thermal treatment. In this type of method, surface treatment with an acid is excluded since the wire-drawing lubricant is not solution in the acid. Therefore, the surface treatment takes place electrolytically, using direct current.

In the traditional known methods, the thermal treatment takes place before the surface treatment. During the thermal treatment, the wire-drawing lubricant, which is present on the surface of the wire, is either burnt entirely or partially (muffle-open fire furnaces)

or cracked on the surface of the wire (lead furnace).

After the thermal treatment, and depending on the type of furnace used, there remains on the surface of the wire lubricant residues (burnt or cracked), and oxide residues in an amount that depends on the ambient atmosphere within the furnace; in addition, oxidation of the wire surface that is in contact with the air occurs to an extent that is dependent on the exiting temperature of the wire.

A conventional surface treatment is chemical pickling using hydrochloric acid wherein the acid is at, ambient temperature (25° C.), and the pickling time is about 15 seconds. The pickling time can be reduced to about 8 seconds by increasing the temperature of the acid to 60° C. However the released acid vapours render these conditions difficult to employ.

The electrolytic methods (for example $H_2SO_4$ in direct current) are practically never used. Since the pickling time is also in the range of 10 seconds. Moreover, sulphates are difficult to remove by water cleaning, even with warm water (crystallisation in the presence of iron in the acid). Sulphates, in contrast to chlorides, react very poorly with zinc (lack of zinc on the wire surface).

One of the essential objects of the present invention is to provide a new galvanizing method that obviates the drawbacks of known galvanizing methods, by using a pickling step, possibly combined with a very efficient simultaneous degreasing step, which will result in a considerable reduction not only in the total galvanizing time, but also in the reduction in the equipment for a galvanizing installation itself, i.e., the omission of a separate fluxing step of the zinc bath, which is indispensable in traditional galvanizing methods.

According to the present invention, use is made in the pickling step of a bath of an aqueous solution of hydrochloric acid and/or of a mineral chlorine salt, wherein an alternating electric current is generated so that current flows through the metal elements during their travel in said bath.

Finally, the invention also concerns a galvanizing installation for performing the new method referred to hereinabove. This installation comprises a furnace for the thermal treatment, a pickling and possible simultaneous degreasing device and a molten zinc bath or an electrolytic zinc bath.

Other details and particularities of the invention will become apparent from the description given hereafter by way of a non-limiting example of the invention, with reference to the annexed drawings.

FIG. 3 is a schematic representation, on a larger scale, of an essential part of a pickling device according to an advantageous embodiment of the invention.

FIG. 4 is a partial perspective view, on a larger scale, of a container of a pickling device according to a particular embodiment of the invention.

In the different figures, the same reference numerals relate to the same or analogous elements.

The invention is not necessarily limited to a galvanizing method and installation, but relates in a general way, to a pickling and degreasing method and device which may be applied in any industrial field wherein a pickling and a degreasing method appears to be necessary. However, galvanizing is a preferred application in view of the technical advantages obtained in this specific application. For this reason, the description given hereinafter will mainly relate to a galvanizing method and installation wherein the particular pickling method and device according to the invention are applied.

Figure 1:
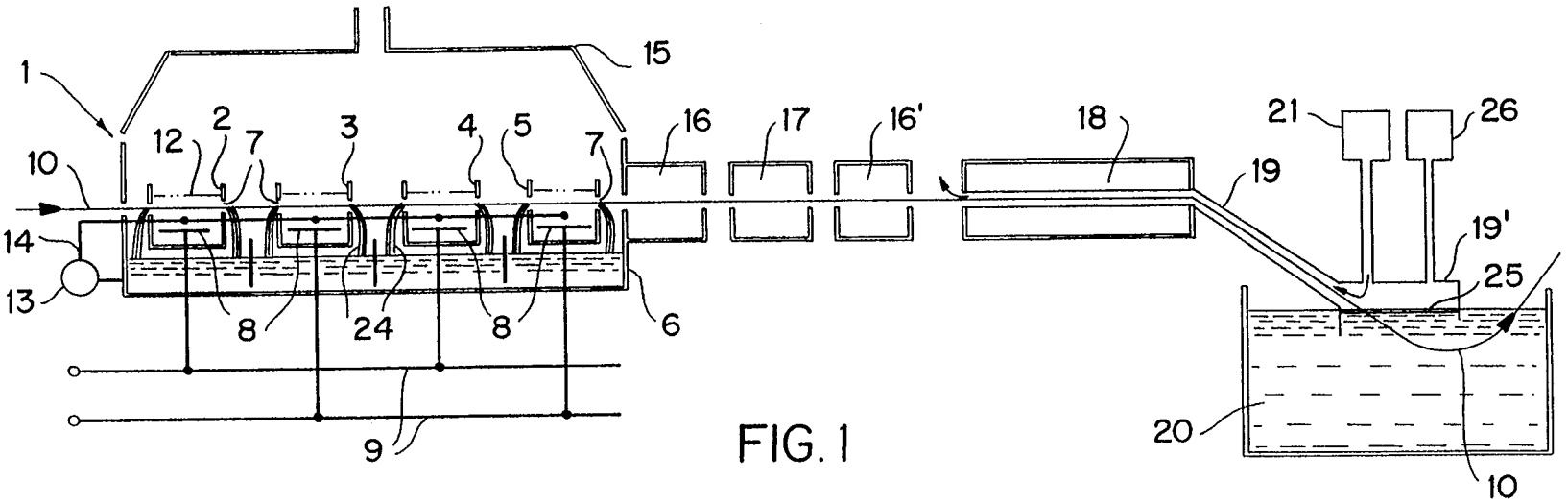
FIG. 1 is a schematical longitudinal representation of a galvanizing line according to a first embodiment of the invention.

FIG. 1 schematically shows a continuous galvanizing installation comprising, in addition to drive means for displacing steel wires 10 in a continuous manner in their lengthwise direction through the installation, a degreasing and pickling device 1 for steel wires 10, a furnace 18 for the thermal treatment of the wires 10 and a container 20 containing molten zinc for coating the pickled and degreased wires with a film of zinc.

Pickling device 1 comprises, in the particular embodiment shown in FIG. 1, four successive containers 2, 3, 4 and 5, the walls of which are made of a non-conducting material, such as polyvinyl chloride or polyethylene chloride, are placed on a certain distance from each other in a collector reservoir 6.

Travelling openings 7 for the wires 10 are provided in the walls of the collector reservoir 6 as in the wall of each of the containers 2 to 5 so that the wires 10 can cross the reservoir 6 and successively each of the containers 2 to 5.

An electrode 8 is arranged above the bottom of each of containers 2 to 5 at a certain distance beneath the travelling wires 10.

Electrode 8 of a predetermined container is connected to one of the poles of a low voltage electric current generator, while the electrode of an adjacent container is connected to the other pole of this generator.

In this way, if the electrode of the first container 2 is, for example, on a possible potential, the electrode of container 3 will be on a negative potential, the electrode of container 4 will be on a positive potential, and finally the electrode of container 5 will be on a negative potential.

In FIG. 1, the electric current generator itself has not been shown only the conductors 9, to which the electrodes 8 of the different containers are connected in parallel, are shown.

According to the present invention, the electric current generator may be a direct current generator or an alternating current generator. In the latter case, the generator is advantageously formed by the electricality mains, the frequency of which is, for example, 50 or 60 Hertz, depending upon the country where the installation is installed.

Each of the containers contains a solution of hydrochloric acid and/or a mineral chlorine salt, the level 12 of which is situated above the travelling openings 7 for the wires 10. In this way, the wires 10 moving through the openings 7 across the containers 2 to 5, will be immersed in the solution of hydrochloric acid and/or of a mineral chlorine salt.

The solution of hydrochloric acid and/or a mineral chlorine salt contained in the containers 2 to 5 is continuously discharged through the travelling openings 7 into the collector reservoir 6.

In order to maintain the level 12 of the solution in the containers above the level of the travelling openings 7, the solution recuperated in the collector reservoir 6 is recirculated by a pump 13 through a feed duct 14 to containers 2 to 5. This duct 14 debouches preferably into one of the lateral walls of each of containers 2 to 5 at on the level or slightly below the travelling level of the wires 10 in containers 2 to 5, so as to create a flow of the electrolyte solution transversely to the travelling direction of the wires 10 (see FIG. 4).

This arrangement results in the baths of hydrochloric acid and/or a mineral chlorine salt in the different containers being practically insulated electrically from one another and the flow of electric current from one electrode of one of the baths to the electrode of the adjacent bath taking place mainly through the wire portions extending between the two adjacent containers.

Therefore, if there is no wire, practically no current can flow.

The collector reservoir 6 containing the different containers 2 to 5 is preferably placed under an aspiration hood 15, which allows evacuation of the formed gases and the possible vapours of the electrolyte.

The degreased and pickled wires leaving the device 1 enter immediately into an air blowing box 16 for driving the acid taken along on the surface of the wires 10 upstream.

Subsequently, the wires pass through a water cleaning unit 17.

A second air blowing box 16' arranged downstream the cleaning unit 17, allows the elimination of water taken along onto the wires.

The particular embodiment of the galvanizing installation, as represented in FIG. 1, further comprises a tube furnace 18, wherein the degreased and pickled wires undergo a thermal treatment.

This furnace is extended by a tight chamber 19 which debouches into a molten zinc container 20.

The tight chamber 19 is, for example, composed of tubes extending in line with the tubes of the furnace 18 and ending in a caisson 19', which is open towards the bottom and which is partially immersed into the molten zinc container 20. This chamber 19, as well as the furnace 18, are supplied with a neutral or slightly reducing gas, for example, nitrogen container a small amount of hydrogen. This gas is for example, supplied by a gasbottle 21 and is circulated in counter-current direction along the wires up to the outlet of the furnace 18, where it escapes at the inlet of the furnace 18 into the free air, assuring in this way the protection of the wires against oxidation for the duration of the thermal treatment.

The wires 10, having undergone the thermal treatment in the furnace 18, are deviated towards the bottom in the tubes of chamber 19 and are subsequently immersed immediately, at the location of the caisson 19', into the molten zinc contained in the container 20 so as to be coated with a film of zinc.

Figure 2:
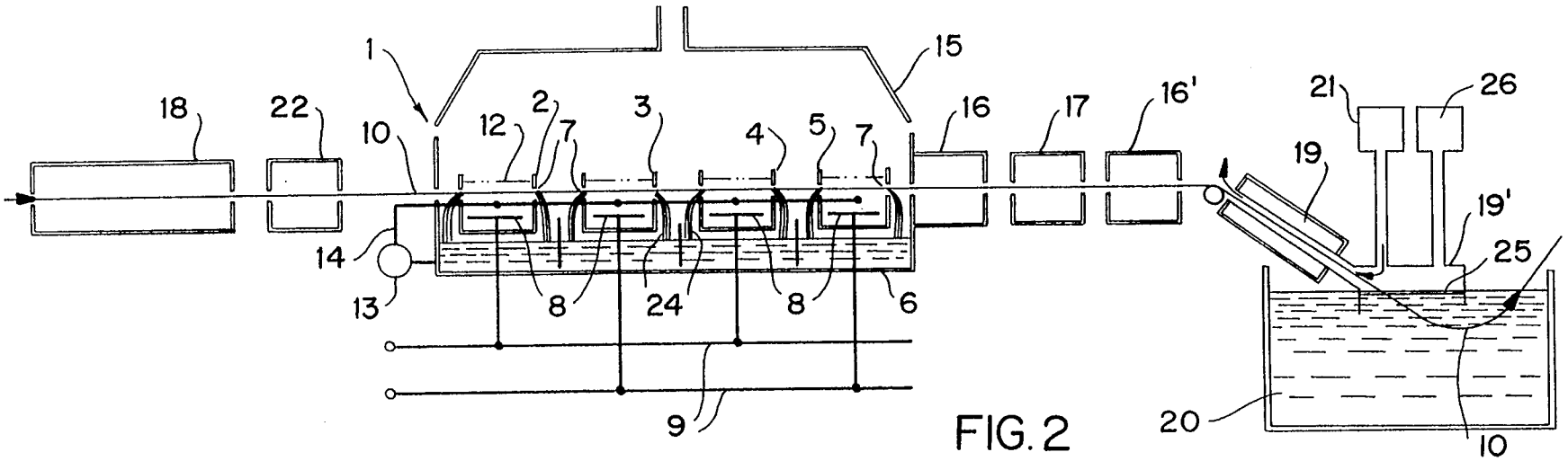
FIG. 2 is a representation of a second embodiment of a galvanizing line according to the invention.

The wires leaving then the molten zinc bath undergo a wiping operation according to techniques which are known, so that such a wiping unit has not been represented in FIG. 1. FIG. 2 relates to a second embodiment of a glavanizing installation according to the present invention which differs from the first embodiment shown in FIG. 1 by the fact that the thermal treatment takes place prior to the pickling step.

An advantage of this second embodiment is that any furnace type can be used for performing this thermal treatment, in contrast to the first embodiment, wherein important precautions have to be taken to avoid the reoxidation of the surface of the wires during the thermal treatment.

In this way,a fluidized bed furnace 18 is advantageously used so that an efficient thermal transfer is obtained with the wires which travel therethrough.

According to the temperature and the nature of the ambient atmosphere within this furnace, a large amount of oxide and lubricant residues will remain on the surface of the wires.

In this second embodiment of the galvanizing installation according to the invention, the wires leaving the furnace 18 will enter immediately into a cooling unit 22 so as to reduce the oxidation of the surface of the wires.

Then, the wires 10 enter into the pickling device 1, which is similar to the one of the first embodiment.

If necessary, the number of containers traversed by the wires may be different due to the fact that the wire are generally covered with a crust of burnt lubricant and that a degreasing operation is in fact unnecessary.

Also, as in the first embodiment, the pickling device is followed successively by a blowing box 16, a cleaning unit 17 and a second blowing box 16'.

The wires dried in the second blowing box 16' enter into the tight chamber 19. However, it may be useful to provide local reheating to bring the temperature of the wires in the range of 100° to 20° C., to eliminate the water traces present on the surface of the wires. Moreover, on the surface of the molten zinc bath, within the caisson 19', there may be provided a flux composed of a layer 25 of a double salt of zinc and ammonium chloride floating on the surface of the molten zinc bath and through which the wires 10 penetrate before entering into the molten zinc 20. This double salt is fed from a reservoir 26.

In the pickling and degreasing device 1, the electrodes 8 are preferably made of graphite.

The voltage applied to the electrodes 8 is advantageously a continuous voltage which may or may not be uniform, for example a pulsed current or an alternating voltage. In the latter case, the frequency of the voltage corresponds advantageously to the frequency of the electricity mains of the region where the installation is installed. Generally, this frequency is 50 or 60 Hertz. In this case, it is sufficient to use a transformer between the electricity mains and the electrodes if a change in the current intensity and the voltage on the electrodes is desired.

It has been found in this way that good results have bene obtained by applying to the electrodes a voltage of 0.15 to 15 Volts, and preferably of 1 to 10 Volts.

The electric current density in the bath of the solution of hydrochloric acid and/or a mineral chlorine salt is advantageously from 10 to 600 $A/dm^2$, and is preferably from 50 to 500 $A/dm^2$.

Moreover, it appears that the speed at which the wires are moving through the containers 2 to 5 may have, in certain cases, depending on the nature of the current applied to the electrodes, an influence on the quality pickling and of the possible degreasing.

In this way, preference is given to travelling speeds of the wire in the acid solution bath of from 30 to 200 meters/minute.

The pickling reactions on the surface of the wires traversing the containers containing a hydrochloric acid solution take place under favorable circumstances when the hydrochloric acid concentration in the bath is from 100 to 300 g/l and preferably from 120 to 250 g/l. The bath temperature may generally vary from 15° and 70° C., preferably from 202 to 60° C.

The number and the size of the different containers and electrodes, as well as the distance of the electrodes with respect to the wires, and the operating parameters are chosen so that the pickling or residence time of the wires in the different baths is in total from 1 to 5 seconds.

The pickling and degreasing efficiency obtained by the hereabove described method and device may be the result of the phenomena described hereafter.

When a predetermined electrode has a positive polarity voltage, the electrode of an adjacent container has a negative polarity. The wire portions facing the positive electrode are charged negatively, whereas the wire portions in the adjacent containers facing the negative electrode are positively charged.

As a result hereof, chlorine is liberated on the positive electrode and hydrogen on the surface of the negatively charged portions. In this way, gas bubbles are formed on the surface of the electrodes and on the surface of the wire portion.

It is admitted that under the effect of the bubbles released onto the electrodes, the fatty lubricant film that may be present on the surface of said wire portions will be disengaged from this surface. This would explain the efficient degreasing obtained by the method and the means of the pickling device according to the present invention.

This pickling and degreasing operation is advantageously improved by subjecting the wires to a vibration in order to enhance the action of the bubbles and their continuous and rapid release from the surface of the wires.

The chlorine generated on the surface of the positively charged wire portions is very active and strongly attacks the surface of these wire portions.

At the moment the wire portion to which the bubbles of gaseous chlorine adhere, is charged negatively, hydrogen bubbles are formed on the surface of the same wire portion. The hydrogen and the chlorine are in a very reactive state, and at least partially, recombine to form gaseous hydrochloric acid, which is a very powerful pickling agent.

Moreover, the synthesis of hydrochloric acid from chlorine and hydrogen is an exothermic reaction, and the heat released onto the surface of the wires also enhance the pickling.

As a result, unexpected quick pickling is obtained by the method according to the present invention.

If use is made of a direct current, i.e. when a predetermined electrode always has the same polarity, an alternating current is generated in the wires as a result of the movement of the wires opposite the successive electrode of an alternating positive and negative polarity, the frequency of which is determined by the travelling speed of the wires opposite the electrodes. Indeed, there is a periodical inversion of the direction of the electric current in the wires as a result of a polarity inversion on the surface during the movement from one electrode up to the following electrode.

Under this hypothesis, the size of the surface of the different electrodes in the travelling direction of the wires, and their mutual distance may have an influence on the pickling and degreasing of the wires.

Moreover, if an alternating voltage is applied to the electrodes, this frequency will interfere with the frequency generated in the wires due to their travelling speed.

Therefore, by applying a continuous voltage or a voltage having a relatively low frequency, such as the frequency of the local electricity mains, which is generally 50 or 60 Hertz, and adjusting the travelling speed of the wires, it is possible to generate in these wires relatively high current frequencies.

This conclusion probably explains why chlorine is not released in baths of hydrochloric acid and/or of mineral chlorine salts, even when a continuous voltage is applied to the electrodes.

The phenomena produced in static tests cannot be transposed as such to continuous tests wherein the wires are moving opposite a succession of electrodes of alternate positive and negative polarity.

If a continuous voltage is applied to the electrodes, it may be useful to connect the positive pole to the electrode of the last container. Moreover, in certain cases, it may be desirable to use an uneven number of successive containers.

In this way, a determined position of a wire traversing the first container will be charged negatively so that hydrogen will be formed on its surface, which will consequently allow to fix immediately the chlorine which will be generated on this portion during its travel through the following container where it will be charged positively.

As the hydrochloric acid gas formed, as mentioned hereinabove, near the surface of the wires is very soluble in water, it will therefore dissolve in the bath.

A portion of the generated hydrogen will be released from the bath, and a corresponding portion of chlorine will react with the water to form hydrochloric acid and oxygen, wherein the latter will escape from the bath.

In this respect, experience has shown that a hydrochloric acid solution subjected to a flow of electric current for several hours will show a higher concentration of hydrochloric acid than in the beginning. The loss of solution volume is due to the decomposition of water into hydrogen and oxygen.

FIG. 3 relates to a second embodiment of certain constructive parts of the pickling device according to the present invention, which can be used in the galvanizing installations illustrated schematically by FIGS. 1 and 2.

According to the second embodiment, the face of the electrode 8, which is directed towards the wires 10, is convex so that the distance between the electrode and the wires travelling opposite this electrode increased progressively from the middle of this electrode towards its two edges extending transversely to this travelling direction.

Indeed,it has been observed that such an electrode allows the generation in the wire portion opposite this electrode of a substantially uniform current density, as a result of which hydrogen and/or chlorine gas bubbles are formed on the surface of the wires in a substantially homogeneous manner along this wire portion. This could therefore, in certain cases, ameliorate the regularity and possible the speed of pickling and degreasing.

Another embodiment, which could also be very important in certain cases, is that the collector reservoir 6 may be divided up into compartments by a partition 11, which is made of an electrically insulting material. Each container through which the wires to be pickled and degreased travel are therefore located in a separate compartment. Moreover, a separate recirculation system, comprising a pump 13 and a feed duct 14 is then provided for each compartment and container group. Such a construction of the galvanizing and pickling device allows a more flexible adjustment of the pickling baths in each of the containers. If necessary, the hydrochloric acid concentration can be varied from one container to the other. Further, in other cases, openings 23 can be provided in the caissons 11, preferably near the bottom of the reservoir 6, permitting the electrolyte solution to flow from one compartment to the other. In this way, use could be made of one single circulation pump 13 for feeding the different containers 2 to 5 with electrolyte solution. Moreover, valves could be provided for adjusting the openings 23 and even for closing them when this is considered to be necessary. Preferably, the jets 24 of overflowing solution from adjacent containers should not touch each other, so as to prevent a flow of electric current from one container to the other through these jets.

Hereafter are given some examples of pickling and degreasing a wire in a device of the type illustrated by the annexed figures.

The conditions wherein the tests have been performed in examples 1 and 2 given hereafter are as follows:

HCl electrolyte diluted in $H_2O$: about 13° Be.
Electrolyte temperature: 20° C.
Travelling speed of the wires: variable, higher than 100 m/min.
Alternating voltage lower than 12 volts.
Variable frequencies: from 0 Hz included to 50/60 Hz included.
"Wire-electrode" distance: from 30 to 50 mm
Current density: variable from 50 to 500 A/dm$^2$.

EXAMPLE 1

Soft iron wire
Diameter 1.25 mm
Use wire-drawing lubricant: stearate
Alternating voltage: 2volts 50 Hz
Travelling speed of the wire: 60 m/min.
Number of electrodes: 10 Intensity 10 A
Length of the electrodes in the travelling direction of the wires: 15 cm
"Degreasing/pickling" time: 1 second Performed surface treatment: first case: before thermal treatment second: after thermal treatment (FIG. 2).

The results obtained in the two cases were conform with the galvanizing norms as to the adhesion of the zinc coating.

EXAMPLE 2

Soft iron wire
Diameter 0.9 mm
Used wire drawing lubricant: stearate
Alternating voltage: 2volts - 60 Hz
Wire travelling speed: 150 m/min.
Number of electrodes: 19. Intensity 120 A.
Length of the electrodes: 15 cm
Pickling time: 1 second
Surface treatment: first case: before thermal treatment (FIG. 1); second case: after thermal treatment (FIG. 2).

The results obtained in the two cases were in conformity with the galvanising norms as to the adhesion of the coating.

EXAMPLE 3

Soft iron wire
Diameter 1.25 mm
Used wire-drawing lubricant: stearate
Alternating voltage: 2 volts - 50 Hz
Wire travelling speed: 70 m/min.
Number of electrodes: 10. Intensity 15 A.
Length of the electrodes in the travelling direction of the wires: 15 cm
"Degreasing/pickling" time: 1 second
Performed surface treatment: first case: before thermal treatment second case: after thermal treatment.

The electrolyte was composed of a 5% NaCl aqueous solution.

It will be clear that the invention is not limited to the hereabove described embodiments and that many variations can be considered, without departing from the spirit and scope of the present invention.

For example, the wires traversing the different successive baths can be guided onto the edges of the containers above which the acid solution flows over in a continuous manner at flow rate that mains the wires in complete immersion in the overflowing solution.

If necessary, electrodes may be provided above the wires.

Moreover, in certain cases, different frequencies could be superimposed in the electrodes 8. More particularly, an alternating current could be superimposed onto a direct current.

If the wires entering the pickling device 1 have a surface heavily covered with lubricant, it may be useful to provide in the containers 2 to 5 particular means for evacuating the lubricant on the surface of the bath.

In still other cases, the film of zinc on the surface of the elongated elements 10 can be produced by electrolysis.

Of course, if the electrolyte solution is formed form hydrochloric acid and at the same time from a mineral chlorine salt, the acid as well as the salt will be present in a dissociated form, as it will be the case anyway if the solution is formed only from hydrochloric acid or from a mineral chlorine salt.

What is claimed is:

1. A method for pickling elongated metal elements, comprising moving said elements in a substantially continuous manner in their lengthwise direction through at least two successive separate baths of an aqueous electrolyte solution of hydrochloric acid and/or a mineral chlorine salt have a temperature of from 15° to 70° C., wherein in each bath ere is placed at least one electrode, and an electric voltage is applied to said electrodes in such a manner that the polarity of the electrode of one of said baths is always different from the polarity of the electrode of an adjacent bath, said baths being substantially insulated from each other so that electric current flows between two adjacent baths mainly via that portion of said element moving between said two adjacent baths, and said electric current having a frequency of 50 to 70 Hz.

2. The method as claimed in claim 1, wherein the voltage applied to said electrode is from 0.5 to 15 volts.

3. The method as claimed in claim 2, wherein the voltage applied to said electrode is form 1 to 10 volts.

4. The method as claimed in claim 1, wherein the electric current density in said electrolyte solution is from 10 to 600 $A/dm^2$.

5. The method as claimed in claim 4, wherein the electric current density is from 50 to 500 $A/dm^2$.

6. The method as claimed in claim 1, wherein said elements are moving in said electrolyte solution at a speed of from 30 to 200 m/minute.

7. The method as claimed in claim 1, wherein said hydrochloric acid and/or mineral chlorine salt are present in said electrolyte solution in a concentration of from 100 to 300 g/l.

8. The method as claimed in claim 7, wherein the concentration of said hydrochloric acid and/or mineral chlorine salt is from 120 to 250 g/l.

9. The method as claimed in claim 1, wherein the pickling time is from 1 to 5 sec.

10. The method as claimed in claim 1, wherein said electric current has a frequency of 50 to·60 Hz.

11. The method as claimed in claim 1, wherein the bath temperature is from 20° to 60° C.

12. A device for pickling elongated metal elements, comprising at least two successive baths, said baths being substantially insulated from each other and said elongated metal elements moving there through, each bath containing a solution of hydrochloric acid and/or a mineral chlorine salt and an electrode that is placed in each of said baths at a certain distance beneath a path along which said elements move, the electrode of a predetermined bath being connected to one of the poles of a low voltage electric current generator and the electrode of an adjacent bath being connected to the other pole of said generator, said generator providing an electric current having a frequency of 50 to 70 Hz.

13. The device as claimed in claim 12, wherein said baths are successive separate containers or compartments having walls made of nonconducting material and are arranged in a collector reservoir, said device further comprising means for circulating said solution of hydrochloric acid and/or a mineral chlorine salt between said reservoir and each of said containers or compartments.

14. The device as claimed in claim 12, wherein said electrode has such a shape and are disposed at such a distance from said elements to maintain in said elements, opposite each location of said electrodes, a substantially constant current density.

15. The device as claimed in claim 14, wherein said distance between said electrode and said elements moving opposite said electrode increases progressively from the middle of said electrode towards its two edges.

16. The device as claimed in claim 12, wherein said electrodes are graphite.

17. The device as claimed in claim 12, further comprising means for vibrating said elements in at least one of said baths.

18. The device as claimed in claim 12, wherein said generator is a direct current generator.

19. The device as claimed in claim 12, wherein said electrode is connected to electricity mains through an intermediate voltage transformer.

20. A method for continuously galvanizing elongated metal elements, comprising at least a thermal treatment step, a pickling step and a step of coating the surface of said elements with a film of zinc by hot dipping said elements in a molten zinc bath, said elements being moved in a substantially continuous manner in their lengthwise direction through each of said steps, said pickling step comprising moving said elements in an electrolyte solution bath of hydrochloric acid and/or a mineral chlorine salt having a temperature of 15° to 70° C., wherein an alternating electric current having a frequency of 50 to 70 Hz is generated so that said current flows through said elements during their travel in said bath.

21. The method as claimed in claim 20, wherein said thermal treatment is performed after said pickling step and prior to said step of coating the elements with a film of zinc.

22. The method as claimed in claim 21, wherein said elements are maintained in an inert or reducing atmosphere to avoid oxidation of the surface of said elements between said pickling step and said coating step with a film of zinc.

23. The method as claimed in claim 22, wherein an inert or reducing gas is circulated in a counter-current direction along said elements between entry into said thermal treatment step and entry into said zinc coating step.

24. The method as claimed in claim 21, wherein said pickling step is combined with a simultaneous degreasing step.

25. The method as claimed in claim 20, wherein said thermal treatment step is performed prior to said pickling step.

26. The method as claimed in claim 25, wherein said thermal treatment step is performed in a fluidized bed.

27. The method as claimed in claim 25, wherein said elements are transferred from said pickling step of step coating step under a substantially inert or reducing atmosphere.

28. The method as claimed in claim 25, wherein the pickled elements are heated before entry into said zinc coating step.

29. The method as claimed in claim 25, wherein said elements are cooled upon leaving said thermal treatment step to reduce oxidation of the surface of said elements.

30. The method as claimed in claim 20, wherein said elements, upon leaving said pickling step, are subjected successively to counter-current gas for driving back acid solution taken along on the surface of said elements, a cleaning operation with water and a drying operation.

* * * * *